United States Patent [19]

Königs et al.

[11] 4,438,786

[45] Mar. 27, 1984

[54] KNIFE CONSTRUCTION FOR A DOUBLE-LIFT OPEN-SHED JACQUARD LOOM

[75] Inventors: Heinz Königs, Krefeld; Hubert Kremer, Grefrath; Hans-Theo Pieters, Krefeld-Hüls, all of Fed. Rep. of Germany

[73] Assignee: Maschinenfabrik Carl Zangs Aktiengesellschaft, Krefeld, Fed. Rep. of Germany

[21] Appl. No.: 343,679

[22] Filed: Jan. 28, 1982

[30] Foreign Application Priority Data

Feb. 20, 1981 [DE] Fed. Rep. of Germany ..... 3106305

[51] Int. Cl.[3] ..... D03C 3/00; D03C 3/08

[52] U.S. Cl. ..... 139/59; 139/65

[58] Field of Search ..... 139/59–65, 139/85

[56] References Cited

U.S. PATENT DOCUMENTS

| | | | |
|---|---|---|---|
| 4,022,251 | 5/1977 | Bucher | 139/59 |
| 4,067,363 | 1/1978 | Keim | 139/59 |
| 4,291,730 | 9/1981 | Kremer et al. | 139/65 |
| 4,296,782 | 10/1981 | Kremer | 139/65 |

FOREIGN PATENT DOCUMENTS

| | | | |
|---|---|---|---|
| 2846793 | 4/1980 | Fed. Rep. of Germany . | |
| 1136558 | 12/1968 | United Kingdom | 139/65 |
| 2047755 | 12/1980 | United Kingdom | 139/65 |

*Primary Examiner*—James Kee Chi

*Attorney, Agent, or Firm*—Martin A. Farber

[57] ABSTRACT

A knife construction for a double-lift open-shed Jacquard loom includes two knife boxes which are movable in opposite directions past each other. The knives of each knife box consist of a carrier member having hook plates fastened thereto and provided with spaced control hooks. Lifter members formed as flat bars controlled by main needles arranged transverse to the knives each include two main noses engageable with the control hooks of the movable knives and a holding-up nose engageable with a stationary upper-shed knife. The formation of the control hooks and the main noses in the control direction of the main needles permits movement of the lifters intermediate the control hooks of a knife. In order to furnish a simplified and stable knife construction in which the hook plates and their control hooks can be manufactured as stamped parts and replaceably fastened to the carrier part it is proposed that the control hooks (18) of a knife (1) be formed at the vertical edges of a plurality of hook plates (3), and that each hook plate (3) has between its control hooks (18) a longitudinal slot (8), offset from the middle longitudinal plane, which can be shifted in the direction of control of the main needles (15). The individual hook plates (3) are positioned with uniform indexing on the carrier part (2) of the knife (1).

19 Claims, 4 Drawing Figures

KNIFE CONSTRUCTION FOR A DOUBLE-LIFT OPEN-SHED JACQUARD LOOM

The present invention relates to a knife construction for a double-lift open-shed Jacquard loom having two knife boxes which are movable in opposite directions and pass each other, whose knives consist of a carrier part and of hook plates fastened thereto with control hooks spaced from each other, and also having lifters which are developed as flat bars controllable by main needles arranged transverse to the knives, have two principal noses associated with the control hooks of the movable knives, and have one holding-up nose associated with a fixed upper-shed knife.

In one knife construction of this type known from West German Provisional Patent AS No. 28 46 793, the shape of the control hooks and of the main noses, seen in the control direction of the principal needles, permits passage of the lifters up into a plane lying between the control hooks of a knife. For this purpose, the control hooks must be stamped from the hook plate and be bent off laterally. This involves shaping processes which can be controlled but are nevertheless relatively complicated. Furthermore, the control hooks which are subject to wear can be replaced only together with the entire hook plate of a carrier part.

Proceeding herefrom the object of the present invention is to provide a simplified strong knife construction in which the hook plates together with their control hooks can be produced as stampings and are replaceable attached to the carrier part.

In order to achieve this purpose it is proposed that each hook plate consist of a punched part which can be threaded onto the carrier part and clamped to it and which is provided eccentrically with a longitudinal slot to receive the carrier part.

In one practical embodiment, the individual hook plates can be placed with uniform indexing on the carrier part of the knife and be clamped to it. It has furthermore proven beneficial to provide a clamping bar between each carrier part and its hook plates, which bar extends parallel to the carrier part and is clamped between the hook plates against the carrier part by means of tightening screws. In order that the indexing of the individual hook plates cannot change, the carrier part is advantageously provided at its lower edge and the clamping bar on its top side with notches into which the hook plates can engage.

It has furthermore proven beneficial to increase the moment of resistance of the carrier parts, as seen in the control direction of the main needles, by providing at the upper end an angular bend which extends over their entire length and engages into a widening provided at the upper end of the hook plates, said widening being in communication with the slots.

A knife construction developed in accordance with the invention has the outstanding advantage that the hook plates can be individually produced, threaded onto the carrier parts and connected to the latter. If, after a longer period of operation, one or more control hooks on a hook plate has become worn it is readily possible to replace even an individual hook plate. For this purpose the hook plate together with the worn control hooks is cut into two halves and removed from the carrier part. The adjacent hook plates are then pushed up and the missing hook plate is supplemented at the end of a carrier part.

Further details, advantages and objects, of the invention will become evident from the following description of the accompanying drawings in which a preferred embodiment of a knife construction developed in accordance with the invention is schematically shown. In the drawings.

Figure 1:
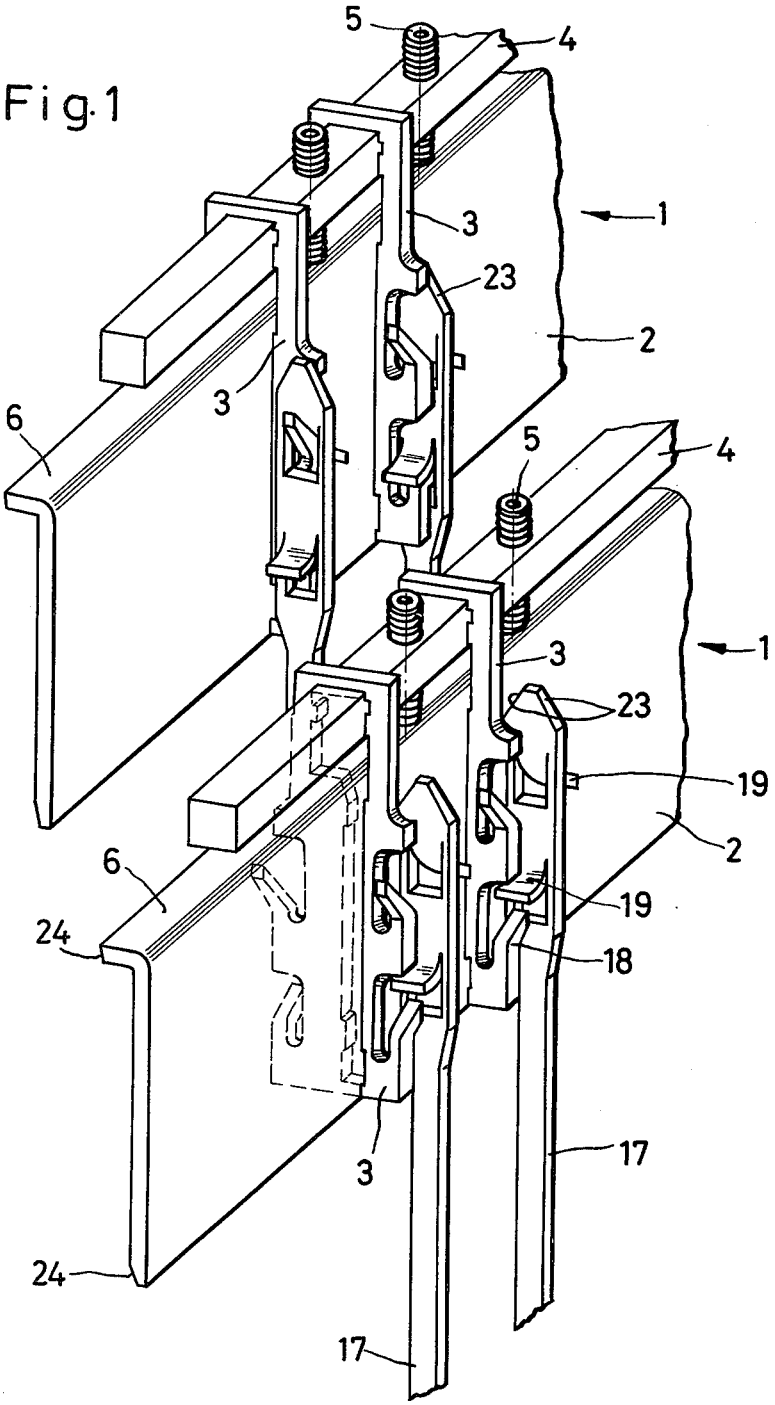
FIG. 1 shows the end sections of two knives each having two hook plates placed thereon, seen in perspective.
Figure 2:
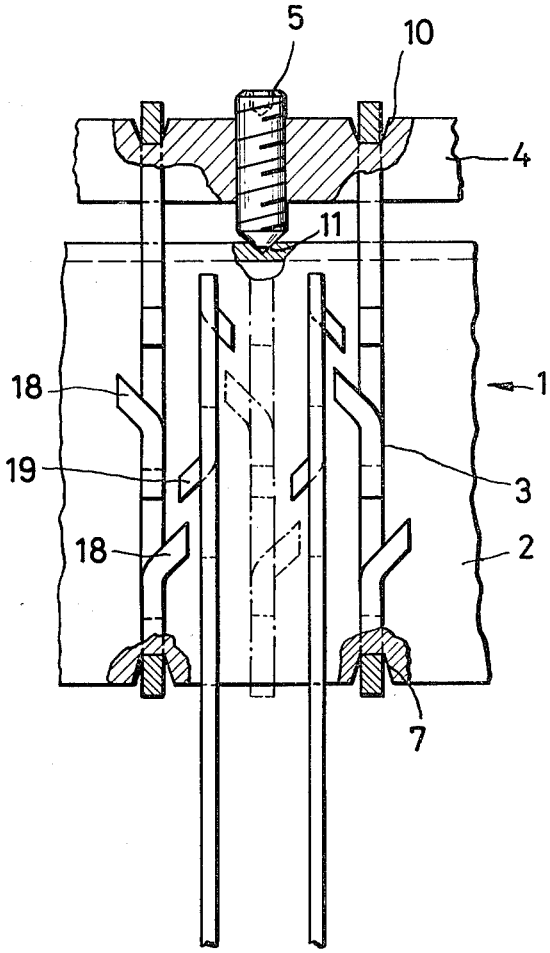
FIG. 2 shows a portion of a knife, partially in section, as seen in side view.

Each knife 1 consists of a carrier part 2, having a plurality of hook plates 3 spaced in lengthwise direction from each other, a clamping bar 4, and several tightening screws 5.

The carrier part 2 is provided at its upper edge with an angular bend 6 which increases its static moment of resistance seen transverse to the lengthwise direction and at the same time serves as abutment for the tightening screws 5. Furthermore, each carrier part 2 is provided at its lower edge with notches 7 within which the hook plates 3 are spaced.

The hook plates 3 have a longitudinal slot 8 shifted to one side from their middle longitudinal plane, for reception of the carrier part 2. At its upper end, the longitudinal slot 8 opens into a widening 9 into which the bent edge 6 of the carrier part 2 extends and which is intended to receive the clamping bar 4.

The clamping bar 4 is also provided with notches 10 within which the hook plates 3 are spaced. In this way the hook plates 3, after locational engagement in the notches 7 and 10, can be clamped by the tightening screws 5 between the carrier part 2 and the clamping bar 4. In order that the hook plates 3 are aligned at right angles to the longitudinal axis of the carrier part 2, the bent edge 6 has set points 11 for the clamping screws 5 at a distance apart equal to the indexing of the hook plates 3.

Figure 4:
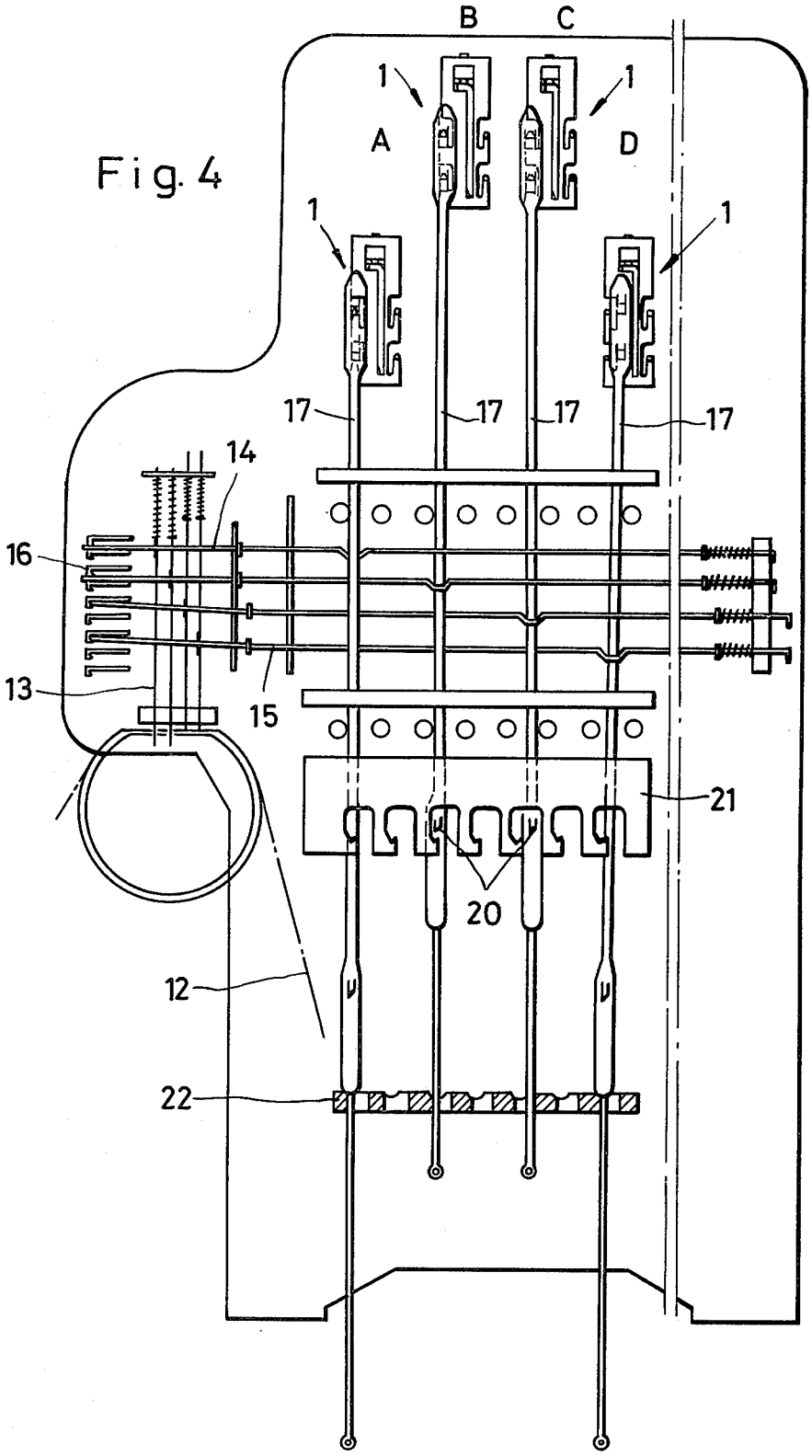
FIG. 4 shows diagrammatically the construction of a double-lift open-shed Jacquard loom having four lifters in different control positions, seen in side view.

The function of a double-lift open-shed Jacquard loom having a knife construction developed in accordance with the invention will be described below with reference to FIG. 4. The different positions of the knives 1 have been designated in a continuous series by the letters A, B, C and D.

Lifters 17 are controlled by a pattern card 12 in known manner via a needle mechanism consisting of feeler needles 13, head needles 14 and main needles 15, having a push grid 16.

For position A of the lifter 17 the corresponding feeler needle 13 has found a hole in the pattern card 12 so that the head needle 14 is not pushed away by the push grid 16 and therefore remains in position of rest together with the corresponding main needle 15. The lifter 17 is therefore not pushed away so that a control hook 18 on the hook plate 3 of the upward-moving knife 1 engages below a main nose 19 on the lifter 17 and pulls the latter upward from the lower shed position into the upper shed position which corresponds to position B. Upon the lowering of the knife 1, from which the lifter 17 is suspended, it is placed by means of a holding-up nose 20 on an upper-shed knife 21.

In position B of the knife 1, the lifter 17 can remain in the upper shed when the corresponding feeler needle 13 has again found a hole in the pattern card 12 and therefore the corresponding main needle 15 is not moved.

In position C the feeler needle 13 of the lifter 17 has found a hole in the pattern card 12 so that the feeler 17 is pushed away via the push grid 16 over the preneedle mechanism and the holding-up nose 20 is thus pushed out of the region of the upper-shed knife 21. The lifter 17 is then brought from position C with knife 1 into the lower shed, or position A, in which it is deposited on a lifter bottom 22.

In position D the lifter 17 is in the low shed position on the lifter bottom 22. The corresponding feeler needle 13 has not found any hole in the pattern card 12 so that the lifter 17 is pressed away by the push grid 16 over the preneedle mechanism. In this way the upper end of the lifter 17 is swung by the main noses 19 in the direction towards the carrier part 2 of the knife 1 to such an extent that the main noses 19 come out of engagement with the control hooks 18 of the hook plate 3 when the knife 1 is moved from the lower shed position into the upper shed position. A lifter in position D therefore remains in the lower shed on the lifter bottom 22.

Figure 3:
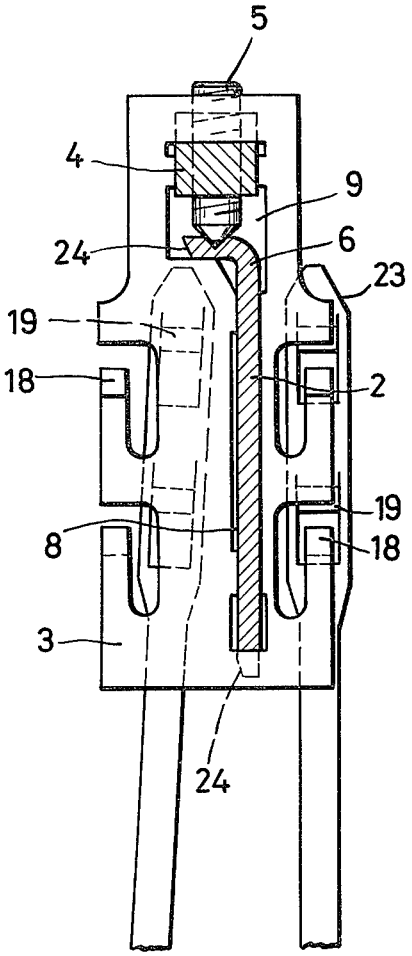
FIG. 3 shows the same knife as in FIG. 2, turned through 90°, seen in side view.

The lifters 17 are provided on their head with oblique surfaces 23 and the carrier parts 2 are provided at their upper and lower edges with corresponding oblique surfaces 24 (as most clearly shown in FIG. 3) at such an angle that the lifters 17 are urged off in the case of erroneous position and forced into the correct position.

All new features mentioned in the specification and shown in the drawings are essential to the invention even if they are not expressly included in the claims.

LIST OF REFERENCE NUMBERS

1 Knife
2 Carrier part
3 Hook plate
4 Clamping bar
5 Tightening screw
6 Angular bend
7 Notch
8 Longitudinal slot
9 Widening
10 Notch
11 Set point
12 Pattern card
13 Feeler needle
14 Head needle
15 Main needle
16 Push grid
17 Lifters
18 Control hooks
19 Main nose
20 Holding-up nose
21 Upper-shed knife
22 Lifter bottom
23 Oblique surface
24 Oblique surface

We claim:

1. In a knife construction for a double-lift open shed Jacquard loom having two knives movable in opposite directions passing each other, the knives include a carrier member and at least one hook member fastened thereto, the hook member having spaced control hooks thereon, and a movable lifter member movable in said opposite directions having two main noses engageable with the control hooks of the hook member, the control hook and the main noses being inclined from the direction of movement of the lifter member to permit passage of the lifter member intermediate the control hooks of the hook member, the improvement wherein the hook member is a stamping supported on and clamped to said carrier member and defines a longitudinal slot to receive the carrier member.

2. The knife construction as set forth in claim 1, wherein individual of said hook members are located with uniform indexing on the carrier member before being clamped to said carrier member.

3. The knife construction as set forth in claim 2, further comprising a clamping bar between each said carrier member and the hook members, and tightening screws clamp said clamping bar between the hook members and the carrier member.

4. The knife construction as set forth in claim 3, wherein the carrier member has a lower edge and the clamping bar has an upper edge, said edges are formed with notches spaced in amount equal to the indexing for the hook members, the latter engaging in said notches.

5. The knife construction as set forth in claim 4, wherein the longitudinal slot of the hook member widens at the upper end into a widening and the carrier member has an upper edge portion provided with an angular bend engaging into said widening.

6. The knife construction as set forth in claim 5, wherein the angular bend of the carrier member is formed with set end points for the tightening screws.

7. The knife construction as set forth in claim 1, wherein the hook member is provided with two to four of said control hooks.

8. The knife construction as set forth in claim 1, wherein the lifter member has a top end portion and the carrier member has upper and lower edge portions, said portions have cooperating oblique surfaces.

9. A knife construction for a double-lift oped shed Jacquard loom comprising a first set of elongated lifter members movable back and forth in a first given direction between two limit positions, each said lifter member including at least one main nose portion, a first knife assembly movable in said first direction by said lifter member and including a carrier member, a first set of hook members corresponding to said first set of lifter members, and being fastened to said carrier member, each said hook member being a stamping extending longitudinally in said first direction and having a longitudinal slot offset a predetermined amount from a middle longitudinal plane of said hook member, said slot being shaped to receive said carrier member such that said hook member surrounds a portion of said carrier member, an edge portion of the hook member being upset to form at least one control hook inclined at a predetermined angle with respect to the first direction and being engageable with said main nose portion such that movement of said lifter member causes movement of said hook member and the carrier member surrounded by said hook member.

10. The knife construction as set forth in claim 9, further comprising a second knife assembly identical to said first knife assembly and a second set of lifter members for moving said second knife assembly in said first direction, opposite to movement of said first knife assembly.

11. The knife construction as set forth in claim 9, further comprising means for detachably clamping the first set of hook members to the carrier member with uniform indexing.

12. The knife construction as set forth in claim 11, wherein said detachable clamping means include an elongated clamping bar disposed between the hook members and the carrier member such that said clamping bar is spaced from said carrier member and said hook members encompass said clamping bar while surrounding said carrier member.

13. The knife construction as set forth in claim 12, wherein said slot has opposite end portions and said carrier member has a lower edge portion which bears against one end portion of said slot, and said clamping bar bears against the opposite end portion of said slot, said carrier member and said clamping bar including means for controlling the spacing between said carrier member and said clamping bar.

14. The knife construction as set forth in claim 13, wherein said spacing means includes screws threaded into said clamping bar and engaging said carrier member.

15. The knife construction as set forth in claim 13, wherein notches are provided in the clamping bar and in said lower edge portion of said carrier member to locate said hook members in their uniform indexed positions.

16. The knife construction as set forth in claim 9, wherein said carrier member has an upper edge portion with a bend, and said slot is shaped to accommodate the bent edge portion of said carrier member.

17. The knife construction as set forth in claim 14, further comprising set points in said carrier member onto which said screws are threaded.

18. The knife construction as set forth in claim 9 or 10, wherein each hook member includes two or four control hooks.

19. The knife construction as set forth in claim 13, wherein an upper end portion of the lifter members has at least one inclined oblique surface formed thereon, and the lower edge portion of said carrier member has a corresponding inclined oblique surface.

* * * * *